US011725788B2

(12) United States Patent
Jones

(10) Patent No.: US 11,725,788 B2
(45) Date of Patent: Aug. 15, 2023

(54) ADJUSTABLE RECESSED LIGHTING APPARATUS

(71) Applicant: SIGNIFY HOLDING B.V., Eindhoven (NL)

(72) Inventor: Mark Owen Jones, South Dartmouth, MA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 46 days.

(21) Appl. No.: 17/617,912

(22) PCT Filed: Jun. 8, 2020

(86) PCT No.: PCT/EP2020/065760
§ 371 (c)(1),
(2) Date: Dec. 9, 2021

(87) PCT Pub. No.: WO2020/249496
PCT Pub. Date: Dec. 17, 2020

(65) Prior Publication Data

US 2022/0299176 A1 Sep. 22, 2022

Related U.S. Application Data

(60) Provisional application No. 62/859,994, filed on Jun. 11, 2019.

(30) Foreign Application Priority Data

Jul. 16, 2019 (EP) ..... 19186422

(51) Int. Cl.
*F21S 8/02* (2006.01)
*F21V 21/30* (2006.01)
*F21Y 115/10* (2016.01)

(52) U.S. Cl.
CPC ..... *F21S 8/026* (2013.01); *F21V 21/30* (2013.01); *F21Y 2115/10* (2016.08)

(58) Field of Classification Search
CPC ..... F21S 8/026; F21V 21/30
See application file for complete search history.

(56) References Cited

U.S. PATENT DOCUMENTS 6,461,021 B1 * 10/2002 Warnecke ..... G02B 7/1827 362/322
11,402,081 B1 * 8/2022 Hargroder ..... F21V 29/70
(Continued)

FOREIGN PATENT DOCUMENTS

CN 204005594 U 12/2014
CN 207569708 U 7/2018
(Continued)

*Primary Examiner* — Christopher E Dunay

(57) ABSTRACT

Implementations are described herein for an adjustable recessed lighting apparatus (100) with a rotation ring (110). In various embodiments, a base (101) may be mounted to a surface and includes a light passage that generally directs light in a first direction (FD). The rotation ring (110) may be rotatably mounted to the base (101) such that the rotation ring (110) is rotatable about the light passage. At least one light source (140) may be mounted within the apparatus (100) to emit light through the light passage in a second direction (SD). A first drive (112) and a second drive (114) may be fixedly secured to the rotation ring (110). Accordingly, when torque is applied to the first drive (112), the rotation ring (110) may rotate relative to the base (101) about the light passage.

16 Claims, 7 Drawing Sheets

(56) References Cited

U.S. PATENT DOCUMENTS

| | | | | |
|---|---|---|---|---|
| 11,428,388 | B1 * | 8/2022 | Hargroder | F21V 21/14 |
| 11,566,779 | B2 * | 1/2023 | Chen | F21V 23/002 |
| 2003/0007353 | A1 | 1/2003 | Patrick | |
| 2007/0019418 | A1 * | 1/2007 | Czech | F21V 21/30 362/364 |
| 2010/0149822 | A1 * | 6/2010 | Cogliano | F21V 21/30 362/365 |
| 2015/0241039 | A1 * | 8/2015 | Fryzek | F21S 8/026 362/419 |
| 2015/0308662 | A1 * | 10/2015 | Vice | F21V 21/30 362/419 |
| 2016/0076757 | A1 | 3/2016 | Seki | |
| 2016/0186967 | A1 | 6/2016 | Mathews et al. | |
| 2017/0234517 | A1 * | 8/2017 | Highbridge | F21V 21/30 362/427 |
| 2017/0292687 | A1 * | 10/2017 | Fujisawa | F21S 8/026 |
| 2017/0299159 | A1 | 10/2017 | Mjelde | |
| 2019/0154238 | A1 | 5/2019 | Wilcox | |
| 2021/0018163 | A1 * | 1/2021 | Maghnagi | F21S 8/026 |

FOREIGN PATENT DOCUMENTS

| | | | |
|---|---|---|---|
| CN | 208331930 | U | 1/2019 |
| EP | 1873445 | A2 | 1/2008 |
| EP | 2308720 | A1 | 4/2011 |
| EP | 2924353 | A1 | 9/2015 |
| GB | 2497925 | A | 7/2013 |
| WO | 2018224938 | A1 | 12/2018 |

* cited by examiner

ADJUSTABLE RECESSED LIGHTING APPARATUS

CROSS-REFERENCE TO PRIOR APPLICATIONS

This application is the U.S. National Phase application under 35 U.S.C. § 371 of International Application No. PCT/EP2020/065760, filed on Jun. 8, 2020, which claims the benefit of U.S. Provisional Patent Application No. 62/859,994, filed on Jun. 11, 2019, and European Patent Application No. 19186422.2, filed on Jul. 16, 2019. These applications are hereby incorporated by reference herein.

TECHNICAL FIELD

The present disclosure is directed generally to lighting. More particularly, various embodiments disclosed herein relate to an adjustable recessed lighting apparatus with a rotation ring that is rotatably mounted to a base of the adjustable recessed lighting apparatus. The adjustable recessed lighting apparatus may additionally include a heat sink assembly that is pivotally mounted to the rotation ring via one or more hinges.

BACKGROUND

Recessed lighting units (sometimes referred to as "downlights" though they are not required to point downward necessarily) are used to aim light emitted from one or more light sources at objects or certain areas. Many recessed lighting units include some sort of compartment or base that is first preinstalled in the ceiling (or other surface), where a housing of the recessed lighting unit is fixedly contained within this compartment or base. The light source(s) may then be installed within the housing of the recessed lighting unit. Further, the recessed lighting unit may include an optical element—such as one or more lenses or an open space defined by one or more interior reflective surfaces—that is designed to direct electromagnetic radiation (i.e. light) emitted by the light source(s) in a particular direction.

Some recessed lighting units are adjustable such that the light source(s) can be rotated and/or pivoted to aim light emitted from the light source(s) at different objects or different areas. Generally, the light source(s), or the housing containing the light source(s), are adjusted by a user to direct light at the different objects or different areas. For example, a user can grab the light source(s), or the housing containing the light source(s), by hand and rotate and/or tilt the light source(s) in a desired to direction such that the light source(s) is directed at a desired object or desired area.

However, due to heat generated by the light source(s) of the recessed lighting unit, the light source(s) and the housing can reach temperatures upwards of several hundred degrees depending on a type of the light source(s) (e.g., LED-based light source(s), incandescent-based light source(s), etc.). Accordingly, if a user rotates and/or tilts the light source(s), then the user's hand may be subject to an intense amount of heat causing injury. Further, if the user adjusts the light source(s) by hand, then the user's hand may obscure the user's view of the direction of the adjusted light source(s), thus the user may have to adjust the light source(s) several times to ensure the light source(s) is directed at a desired object or desired area. Even further, if the user adjusts the light source(s) by hand, then oil on the user's hand may transfer to the optical element—such as one or more of the lenses or the open space defined by one or more of the interior reflective surfaces—thus affecting the ability of the optical element to direct the light.

To account for the heat generated by the light source(s) installed within the housing of the recessed lighting unit, many light sources include heat sinks that are designed to draw heat generated by the light source(s) away, e.g., so that the heat can be dissipated in the environment. Heat sinks often include a series of heat-conducting "ribs" or "fins" constructed with various types of metals and are thermally coupled with the light source(s). In cases in which the light source(s) generate a relatively large amount of heat, the accompanying heat sinks may be rather large.

However, large heat sinks may present a variety of challenges. As one example, spaces in which adjustable recessed lighting units are installed in an area that is often constrained, e.g., in the space between a ceiling and the floor above. Accordingly, if a user wants to rotate and/or tilt the light source(s), then heat sink may also need to rotate and/or tilt, along with the light source(s), in an area that is often constrained, but the user may be not be aware of an orientation of the heat sink when adjusting the light source(s) due to the heat sink being obstructed by the ceiling (or other surface).

SUMMARY

The present disclosure is directed to an adjustable recessed lighting apparatus with a rotation ring. For example, in various embodiments, an adjustable recessed lighting apparatus may include a base that is mounted to a surface (e.g., ceiling) and a rotation ring that is rotatably mounted to the base. The adjustable recessed lighting apparatus may further include a heat sink assembly that is pivotally mounted to the rotation ring via one or more hinges. One or more drives, including at least a first drive and a second drive, may be fixedly secured within the rotation ring. When a torque is applied to the first drive by a mated tool, such as a screwdriver, the rotation ring and heat sink assembly may rotate in unison relative to the base of the recessed lighting apparatus. The rotation ring and heat sink assembly may rotate 360° in either a clockwise or counter-clockwise direction depending on which direction a force is applied that creates torque applied to the first drive. Further, when torque is applied to the second drive by the mated tool, such as the screwdriver, the heat sink and light source may pivot (or pan) relative to the base via the one or more hinges. The heat sink may pivot (or tilt) approximately 22.5° in either a first direction or a second direction depending on which direction a force is applied that creates the torque applied to the second drive.

Consequently, the rotation ring and heat sink of the adjustable recessed lighting apparatus may be rotated in either a clockwise or counter-clockwise direction using a mated tool such that a user can aim light emitted from one or more light sources mounted within the apparatus at a particular object or a particular area without having to touch the light source(s) or the rotation ring. Moreover, the heat sink assembly and the light source(s) thermally coupled thereto may be tilted at different angles (between approximately 0° and) 45° using the mated tool such that a user can aim light emitted from one or more light sources mounted within the apparatus at a particular object or a particular area without having to adjust the light source(s) by hand.

Generally, in one aspect, an adjustable recessed lighting apparatus (the apparatus) is provided and includes: a base that is mountable to a surface and includes a light passage that generally directs light in a first direction parallel to a normal of the surface, a rotation ring that is rotatably mounted to the base such that the rotation ring is rotatable about the light passage, and at least one light source mounted within the apparatus to emit the light through the light passage in a second direction that is oblique to the first direction. The apparatus further includes a first drive and a second drive. The first drive is fixedly secured to the rotation ring and transfers torque applied to applied to the first drive to the rotation ring causing rotation of the rotation ring relative to the base about the light passage. The second drive is fixedly secured to the rotation ring and transfers torque applied to the second drive to a heat sink assembly causing pivoting of the heat sink assembly and the at least one light source relative to the base about one or more hinges.

In some embodiments, wherein the rotation ring may be rotatable about the light passage 360° in a clockwise direction or a counter-clockwise direction. In some embodiments, the heat sink assembly and the at least one light source may pivot independent of the base and the rotation ring.

In some embodiments, the apparatus may further include the heat sink assembly. In some of those embodiments, the heat sink assembly may be thermally coupled to the at least one light source and may be pivotally mounted to the rotation ring via one or more of the hinges such that the at least one light source and the heat sink assembly are pivotable about one or more of the hinges. In some of those embodiments, the heat sink assembly and the at least one light source may be pivotable about the one or more hinges approximately 22.5° relative to the first direction that is parallel to the normal of the surface. In some of those embodiments, the heat sink assembly and the at least one light source may rotate along with the rotation ring when the torque is applied to the first drive. In some of those further embodiments, the rotation ring, the heat sink assembly, and the at least one light source may rotate independent of the base.

In some embodiments, at least one of the first drive and the second drive may be shaped to receive a first type of tool. In some of those embodiments, at least one of the first drive and the second drive may be shaped to receive a second type of tool, where the second type of tool is different from the first type of tool.

In some embodiments, the rotation ring may further include a securing mechanism that, when engaged, prevents the rotation ring from rotating.

Generally, in another aspect, an adjustable recessed lighting apparatus (the apparatus) is provided and includes: a base that is mountable to a surface and includes a light passage that generally directs light in a first direction parallel to a normal of the surface, a rotation ring that is rotatably mounted to the base such that the rotation ring is rotatable about the light passage, at least one light source mounted within the apparatus to emit the light through the light passage in a second direction that is oblique to the first direction, and a heat sink assembly that is thermally coupled to the at least one light source and that is pivotally mounted to the rotation ring via a one or more hinges such that the heat sink assembly is pivotable about the one or more hinges. The apparatus further includes a first drive and a second drive. The first drive is fixedly secured to the rotation ring and transfers torque applied to applied to the first drive to the rotation ring causing rotation of the rotation ring relative to the base about the light passage. The heat sink assembly and the at least one light source rotate along with the rotation ring when the torque is applied to the first drive. The second drive is fixedly secured to the rotation ring and transfers torque applied to the second drive to a heat sink assembly causing pivoting of the heat sink assembly and the at least one light source relative to the base about one or more hinges. The heat sink assembly and the at least one light source pivot independent of the base and the rotation ring.

In some embodiments, the rotation ring, the heat sink assembly, and the at least one light source may rotate independent of the base. In some embodiments, the rotation ring may be rotatable about the light passage 360° in a clockwise direction or a counter-clockwise direction. In some embodiments, the heat sink assembly and the at least one light source may be pivotable about the one or more hinges approximately 22.5° relative to the first direction that is parallel to the normal of the surface.

In some embodiments, at least one of the first drive and the second drive may be shaped to receive a first type of tool. In some of those embodiments, at least one of the first drive and the second drive are shaped to receive a second type of tool, where the second type of tool is different from the first type of tool.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes).

It should be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s).

The term "approximately" should be understood to refer to any stated value and every value within 10% of that value. For example, an angle of "approximately 22.5° " includes 20.25°, 24.75°, and every value in between.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Various embodiments and implementations of the present disclosure are directed an adjustable recessed lighting apparatus with a rotation ring that is rotatably mounted to a base of the adjustable recessed lighting apparatus. The adjustable recessed lighting apparatus may additionally and/or alternatively include a heat sink that is pivotally mounted to the rotation ring via one or more hinges. Accordingly, light source(s) of the adjustable recessed lighting apparatus can be rotated and/or panned (or tilted) while maintaining a thermal coupling with the heat sink.

Figure 1:
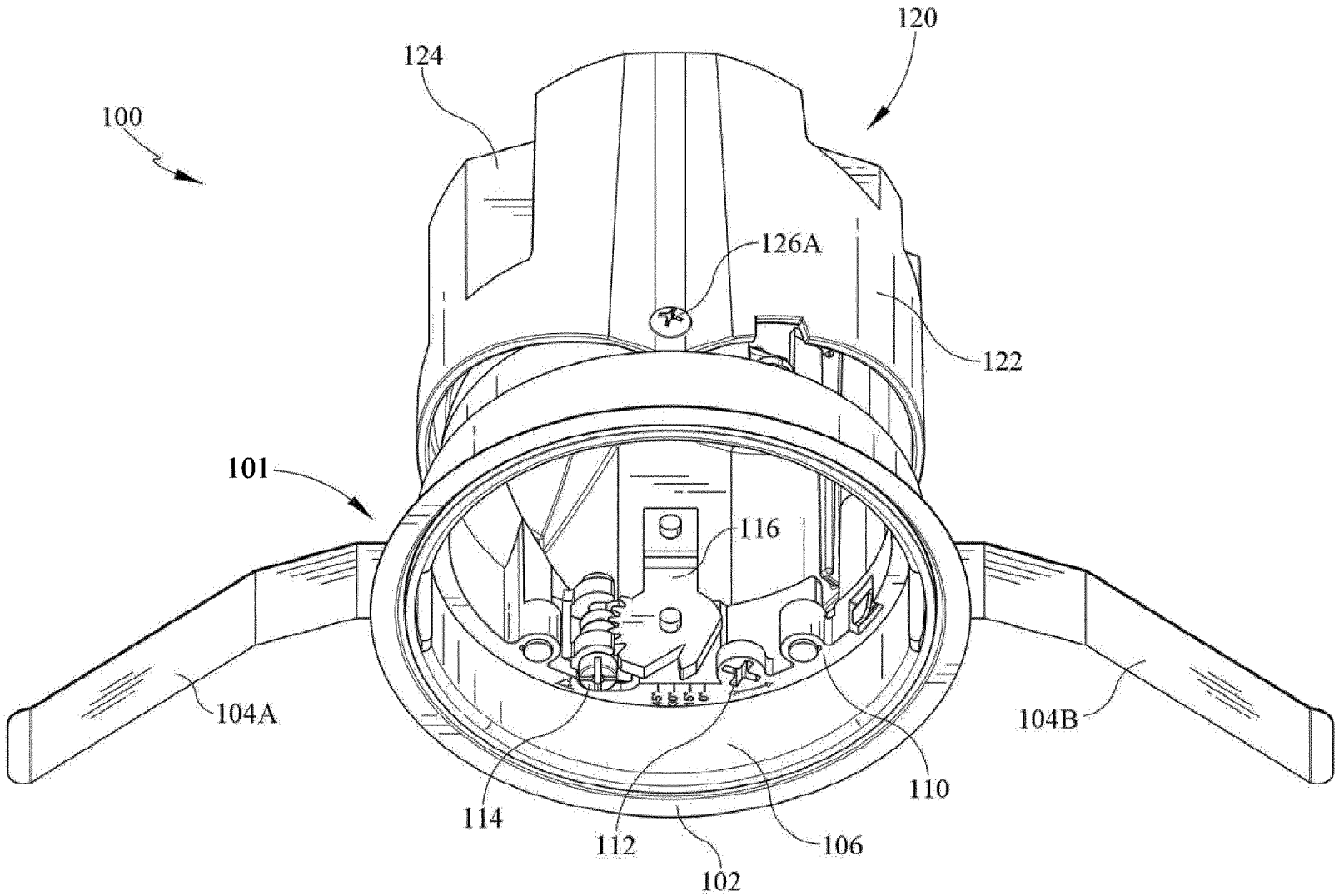
FIG. 1 illustrates a perspective view from underneath a recessed lighting apparatus configured with selected aspects of the present disclosure, in accordance with various embodiments.

Referring to FIG. 1, in one embodiment, an adjustable recessed lighting apparatus 100 (referred to herein as "apparatus 100") includes a base 101, a rotation ring 110 that rotatably mounted to the base 101, and a heat sink assembly 120 that is pivotally mounted to the rotation ring 110, e.g. by way of one or more hinges 126A-B. The base 101 may be designed to ensure the apparatus 100 is mounted to a surface (not depicted) such as a ceiling. For example, the base 101 may include one or more flanges 104A-B as depicted in FIG. 1. In some embodiments, the one or more flanges 104A-B may be retained within the ceiling itself. In other embodiments, the one or more flanges 104A-B may be secured to a top surface of the ceiling, e.g., the surface that is not visible from below, by way of one or more fastening elements, such as drywall screws, nails, staples, pins, bolts, etc. While the one or more flanges 104A-B are depicted in FIG. 1 as being angular brackets, this is not meant to be limiting. In some other embodiments, the one or more flanges 104A-B may have other shapes or be omitted.

In some embodiments, a heat sink assembly 120 (referred to herein as "heat sink 120") may be pivotally mounted to the rotation ring 110, e.g. by way of a hinge 126A. The heat sink 120 may include at least an outer surface 122 and a plurality of fins (or ribs) 124 that form part of a heat sink 120. The fins 124 may be constructed with thermally conductive materials such as various types of metals. As will be described in further detail below (e.g., as described in FIGS. 5-7), the heat sink 120 may tilt approximately 22.5° relative to a normal of the surface (e.g., ceiling) the apparatus is mounted on via the hinge 126A.

Figure 2:
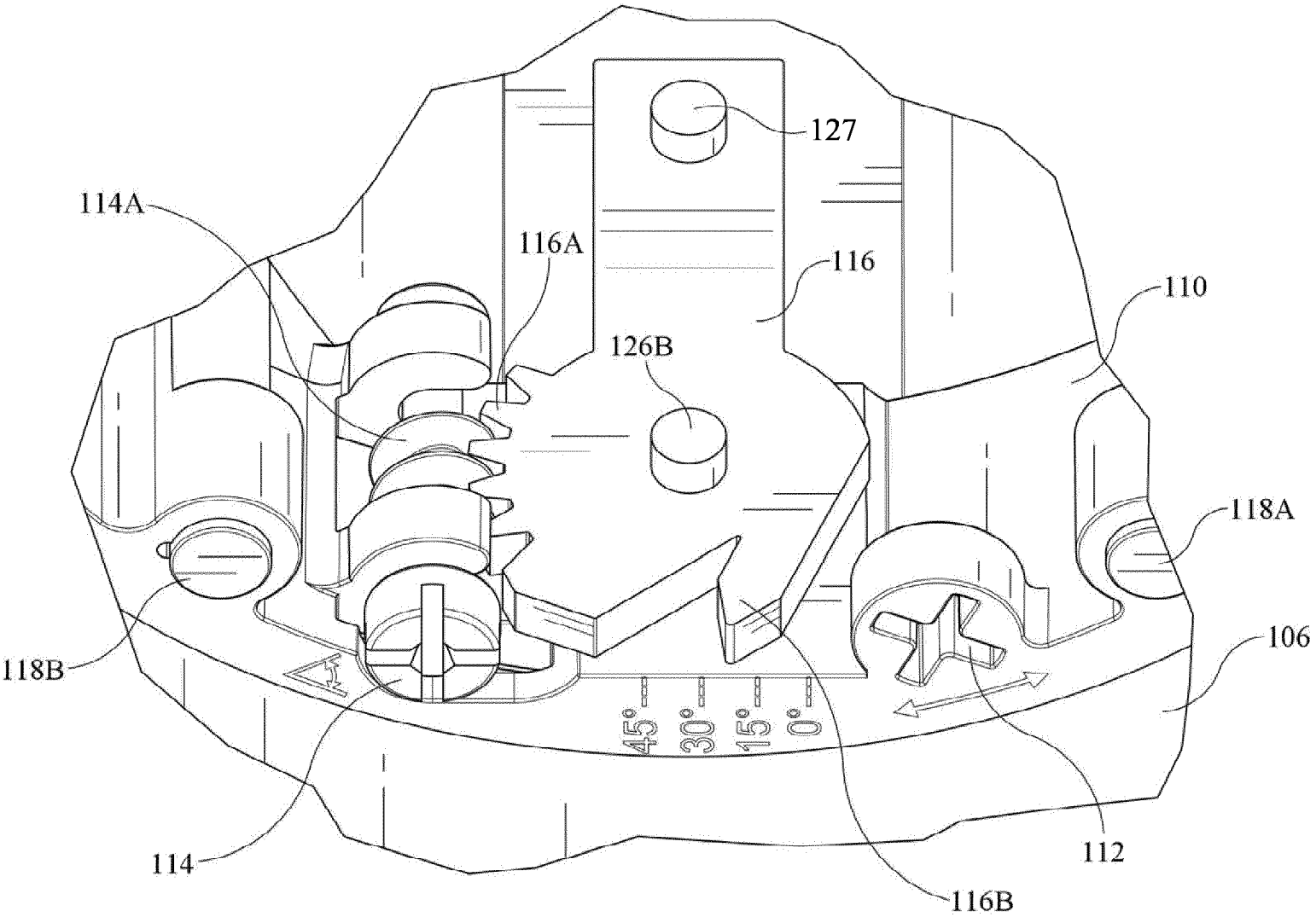
FIG. 2 illustrates a perspective, zoomed-in view from underneath a recessed lighting apparatus configured with selected aspects of the present disclosure, in accordance with various embodiments.

FIG. 2 is a perspective, zoomed-in view of the rotation ring 110 of the apparatus 100 of FIG. 1. Numerous components machined in, casted in, and/or fixedly contained within rotation ring 110 are visible in FIG. 2. The rotation ring 110 includes at least a first drive 112, a second drive 114, and a spur gear 116. Although the first drive 112 is depicted as being cast (or machined) into the rotation ring 110, and the second drive 114 is depicted as being contained within the rotation ring 110, this is not meant to be limiting. In some embodiments, the first drive 112 may be a component that is contained within the rotation ring 110, as opposed to being an integral or cast (e.g. machined) into the rotation ring 110 (as depicted), and the second drive 114 may be a component that is cast (or machined) into the rotation ring 110, as opposed to being contained within the rotation ring 110 (as depicted). Accordingly, the first drive 112 is fixed to the rotation ring 110 and does not independently rotate with respect to the rotation ring 110. The first drive 112 only rotates with the rotation ring 110. In some other embodiments, both the first drive 112 and the second drive 114 may be cast (or machined) into the rotation ring, while in yet other embodiments, both the first drive 112 and the second drive 114 may be contained within the rotation ring 110.

Figure 3:
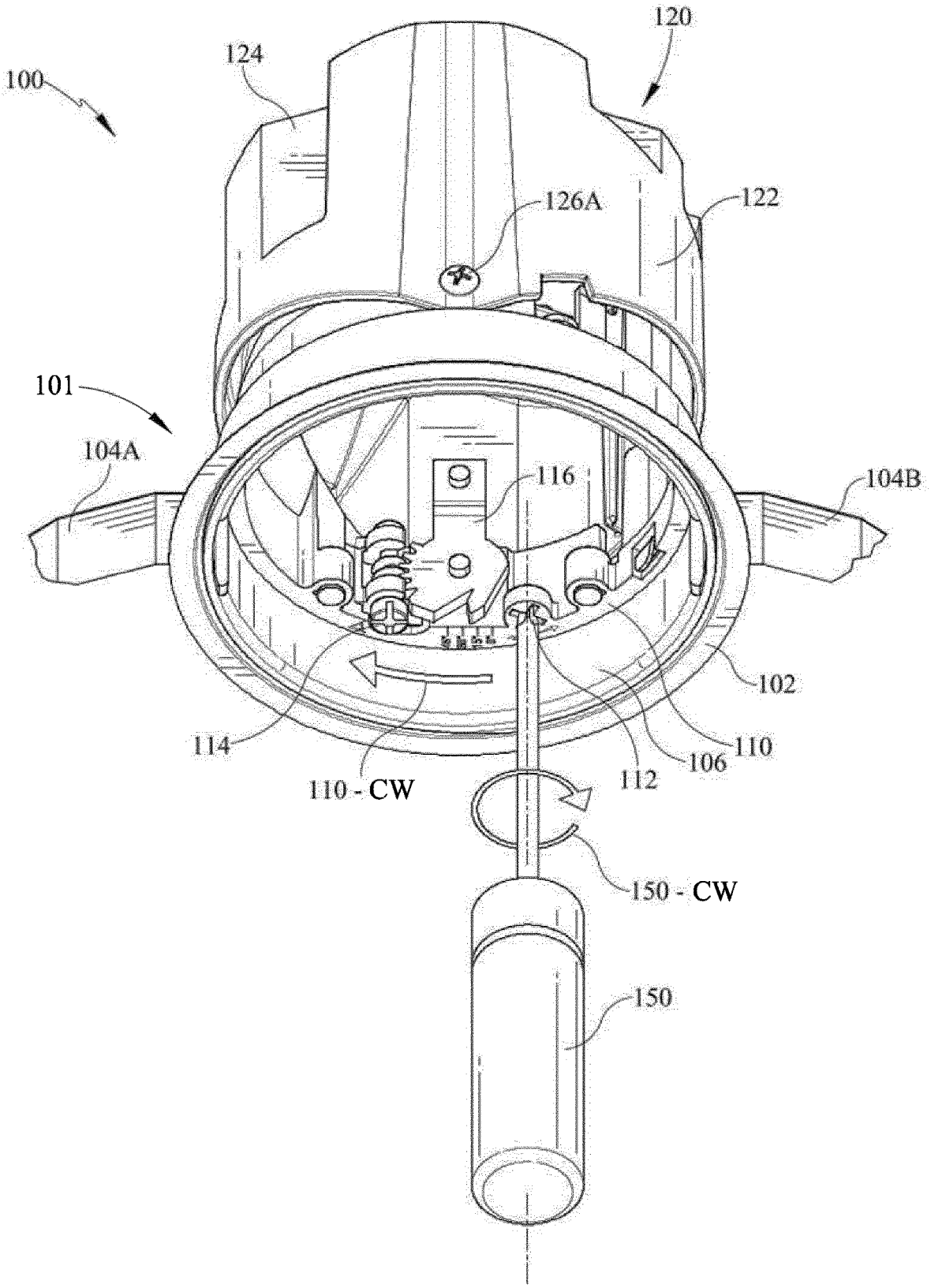
FIG. 3 illustrates a perspective view from underneath a recessed lighting apparatus, including a torque being applied to a first drive by a mated tool, configured with selected aspects of the present disclosure, in accordance with various embodiments.
Figure 5:
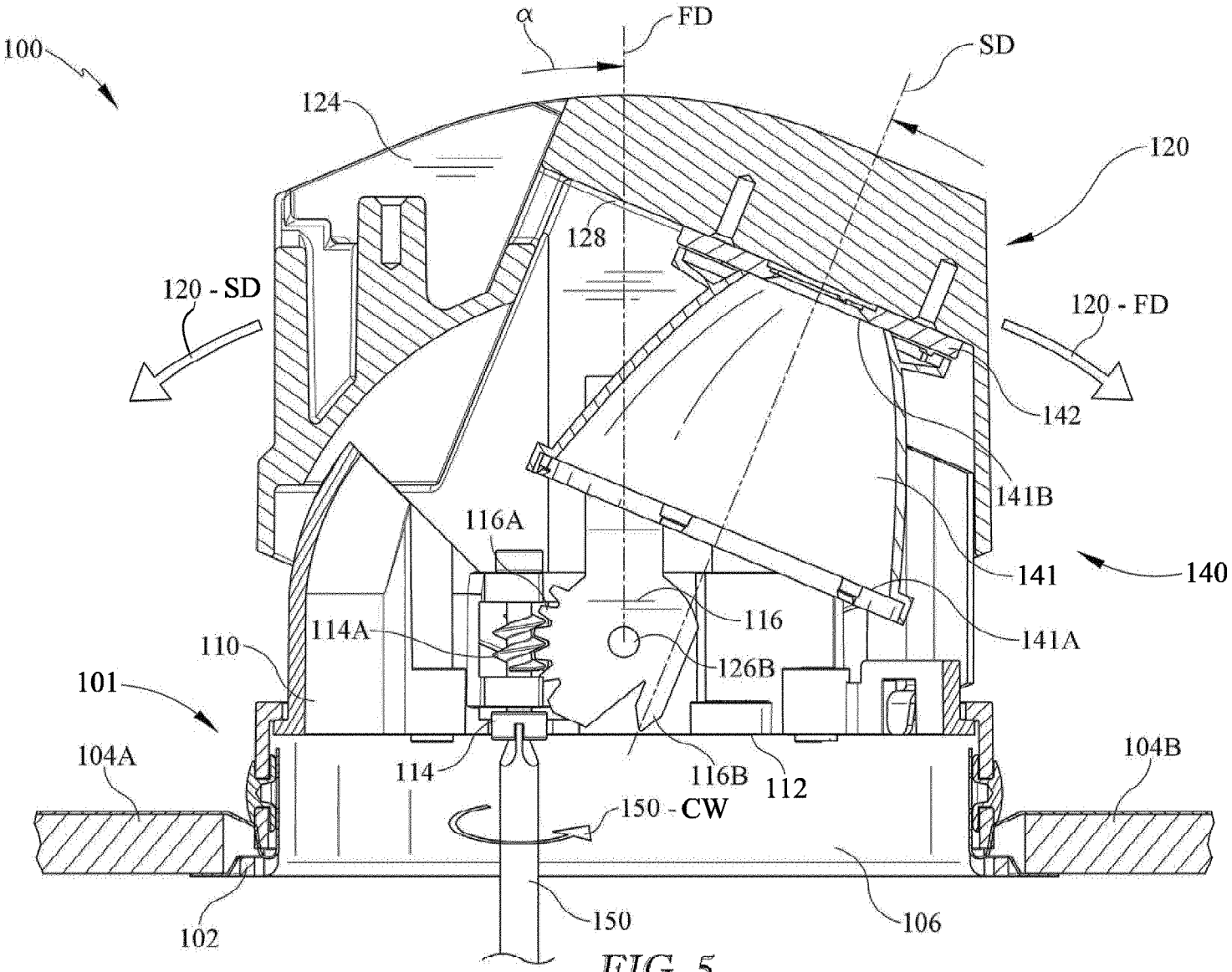
FIG. 5 illustrates a cross-sectional view of a recessed lighting apparatus in a substantially vertical configuration, in accordance with various embodiments.
Figure 6:
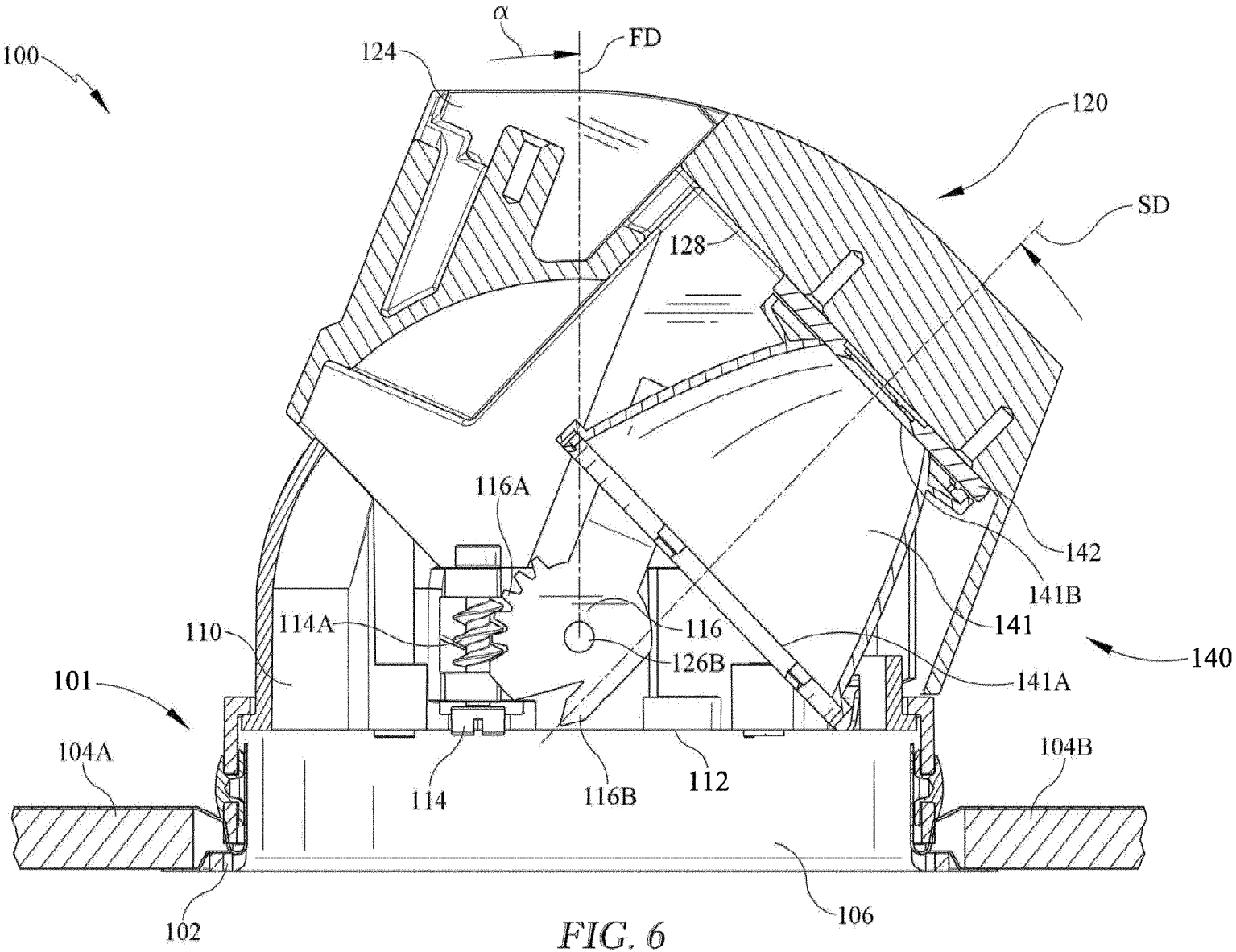
FIG. 6 illustrates a cross-sectional view of a recessed lighting apparatus in a first pivoted configuration, in accordance with various embodiments.

Moreover, although both the first drive 112 and the second drive 114 are depicted as being female drives, i.e., a receptacle that receives and holds a mated tool 150 (e.g., as depicted in FIGS. 3, 5, and 6), that is not meant to be limiting. In some embodiments, the first drive 112 and the second drive 114 may be a male drive, such that a mated tool receives and holds each of the first drive 112 and the second drive 114. In some other embodiments, the first drive 112 may be a female drive and the second drive 114 may be a male drive, while in yet other embodiments, the first drive 112 may be male drive and the second drive 114 may be a female drive. Further, although both the first drive 112 and the second drive 114 are depicted as being shaped as a Phillips head screw drives, that is not meant to be limiting.

In some embodiments, the first drive 112 and the second drive 114 may be slotted drives (e.g., flat drives), cruciform drives (e.g., pozidriv drives), internal polygon drives (e.g., hex socket drives), external polygon drives (e.g., square drives), or hexalobular drives (e.g., polydrive drives). In some other embodiments, the first drive 112 and the second drive 114 may be any other suitable type of male and/or female drives capable of transferring a torque from the first drive 112 and/or the second drive 114 to the rotation ring 110, or any other component affixed thereto, in response to a torque being applied by a mated tool.

Figure 7:
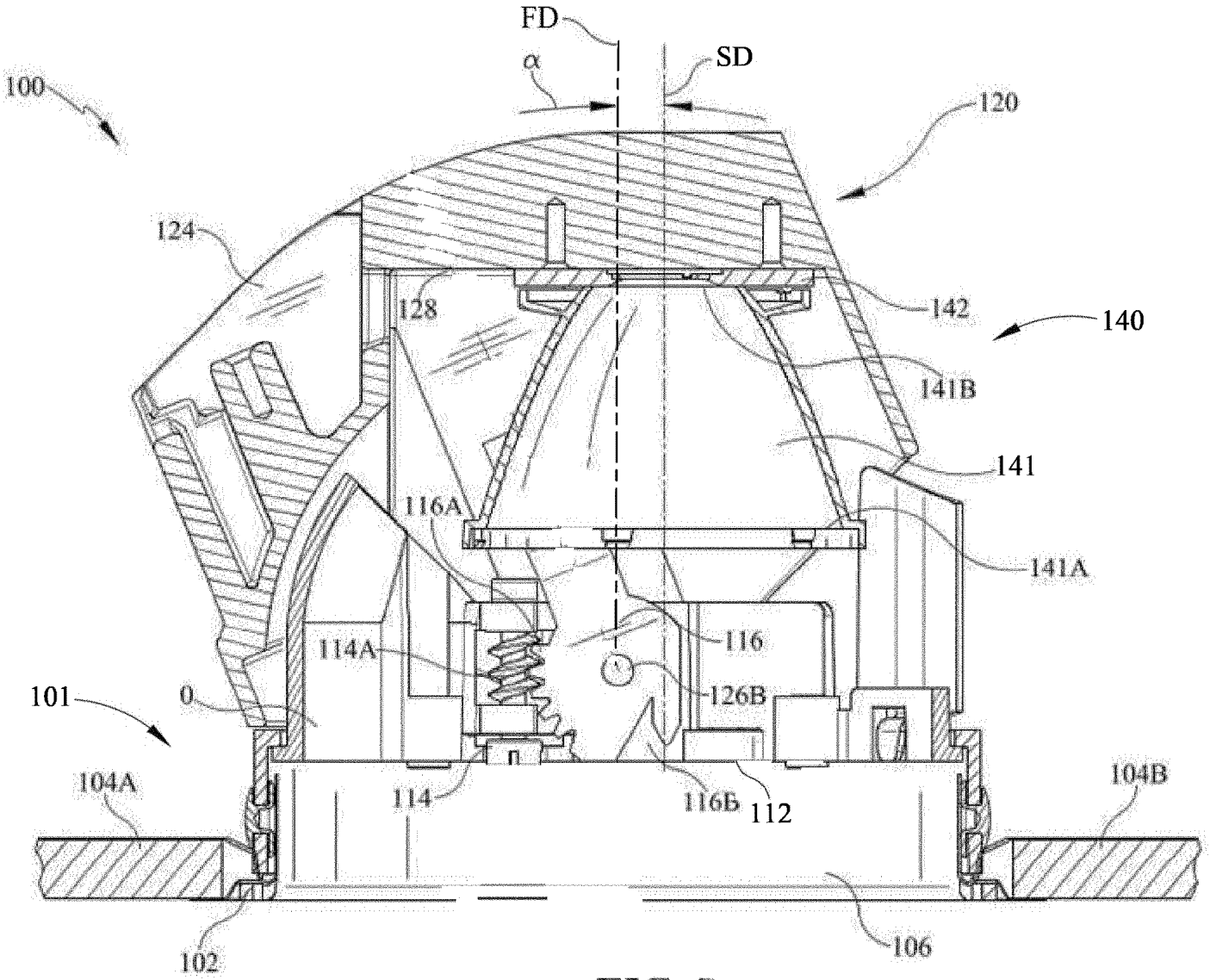
FIG. 7 illustrates a cross-sectional view of a recessed lighting apparatus configured with selected aspects of the present disclosure, in a second pivoted configuration, in accordance with various embodiments.

When torque is applied to the first drive 112, the rotation ring 110 may rotate relative to the base 101 about a light passage (e.g., an opening in the base 101 and the rotation ring 110 through which light is emitted from a light source, such as light source 140 in FIGS. 5-7). The rotation of the rotation ring 110 is described in more detail herein (e.g., as described in FIG. 3). Further, in some embodiments, the rotation ring 110 may include markings adjacent to the first drive 112, such as the double-sided arrow symbol depicted on the rotation ring 110 in FIG. 2. Accordingly, in some of those embodiments, the markings adjacent to the first drive 112 may indicate that the rotation ring 110 will rotate when the torque is applied to the first drive 112.

When torque is applied to the second drive 114, the heat sink 120 (and the light source 140) may tilt relative to the base 101, by way of one or more hinges (e.g. hinge 126A depicted in FIG. 1 and/or hinge 126B depicted in FIG. 2). In some embodiments, the torque applied to the second drive 114 causes a worm gear 114A that is mechanically coupled to the second drive 114 to interface with teeth 116A of the spur gear 116, thus causing the heat sink 120 to tilt via one or more hinges (e.g. hinge 126A depicted in FIG. 1 and/or hinge 126B depicted in FIG. 2). The pivoting of the heat sink 120 (and the light source 140) is described in more detail herein (e.g., as described in FIGS. 5-7).

Further, in some embodiments, the rotation ring 110 may include markings adjacent to the second drive 114, such as the angle measurement symbol depicted on the rotation ring 110 in FIG. 2. Accordingly, in some of those embodiments, the markings adjacent to the second drive 114 may indicate that the heat sink 120 (and the light source 140) will tilt when the torque is applied to the second drive 114. Additionally, the rotation ring 110 may include markings adjacent a foot 116B of the spur gear 116. The foot 116B of the spur gear 116 may indicate an angle of the light source 140 (and also the heat sink 120 by virtue of the heat sink 120 being thermally coupled to the light source 140). For example, as depicted in FIG. 2, the foot 116B indicates the angle of the light source 140 is approximately 22.5°. By applying torque to the second drive 114, the light source 140 can be adjusted by approximately 22.5° in either direction, thus allowing the light source 140 to be directed at an angle between 0° and 45° relative to a normal of a surface where the apparatus 100 is mounted.

FIG. 3 is a perspective view from underneath the apparatus of FIG. 1 and includes the mated tool 150 applying torque to the first drive 112. In some embodiments, and as depicted in FIG. 3, the mated tool 150 may be inserted into the first drive 112 such that the first drive 112 receives the mated tool 150. The mated tool 150 of FIG. 3 is depicted as being a screwdriver. However, and as noted herein, a type of mated tool may depend on a gender of the first drive 112 (e.g., male or female), and shape of the first drive 112 (e.g., a Phillips head screw drive, a slotted screw drive, etc.).

As shown in FIG. 3, when a torque is applied to the first drive 112 by the mated tool 150, the torque may be transferred to the rotation ring 110, thereby causing the rotation ring 110 to rotate relative to the base 101. In some embodiments, and as depicted in FIG. 3, a torque applied to the first drive 112 by the mated tool 150 may cause the mated tool 150 to rotate clockwise 150-CW (as viewed from below the apparatus 100). This torque may be transferred to the rotation ring 110, thereby causing the rotation ring 110 to rotate clockwise 110-CW. In some other embodiments, and although not depicted, a torque applied to the first drive 112 by the mated tool 150 may cause the mated tool 150 to rotate counter-clockwise (as viewed from below the apparatus). This torque may be transferred to the rotation ring 110, thereby causing the rotation ring 110 to rotate counter-clockwise.

Further, an angle of rotation of the rotation ring 110 (i.e., how many degrees the rotation ring 110 rotates about the light passage) may be the same as an angle of rotation of the mated tool 150. For example, if the mated tool 150 is inserted into the first drive 112 and the mated tool 150 is rotated 180° clockwise, then the torque generated by rotating the mated tool 150 in the first drive 112 can be transferred to the rotation ring 110 causing the rotation ring 110 to rotate 180° clockwise in unison with the mated tool 150. As another example, if the mated tool 150 is inserted into the first drive 112 and the mated tool 150 is rotated 270° counter-clockwise, then the torque generated by rotating the mated tool 150 in the first drive 112 can be transferred to the rotation ring 110 causing the rotation ring 110 to rotate 270° counter-clockwise in unison with the mated tool 150.

Accordingly, by using the mated tool 150 to apply torque to the first drive 112, the torque can be transferred to the rotation ring 110. The rotation ring 110 is capable of being rotated at least 360° in either the clockwise or counter-clockwise direction. It should be noted that, in some embodiments, the rotation ring 110 can be rotated more than 360°, but rotating the rotation ring 110 (thereby also rotating the heat sink 120 and the light source 140) beyond 360° may cause unnecessary stress on wiring of the light source 140. In addition to the rotation ring 110 rotating, the heat sink 120 that is pivotally mounted to the rotation ring 110 and the light source 140 that is mounted within the apparatus 100 also rotate. However, the base 101 does not rotate along with the rotation ring 110 when the torque is applied to the first drive 112 by the mated tool 150. In some embodiments, the rotation ring 110 may be rotatably mounted to the base 101 via a clearance fit. In some other embodiments, the rotation ring 110 may be retained by the base 101 using one or more bearings, one or more bushings, or any other suitable mechanism that allows the rotation ring 110 to rotate while being connected to the base 101.

Figure 4:
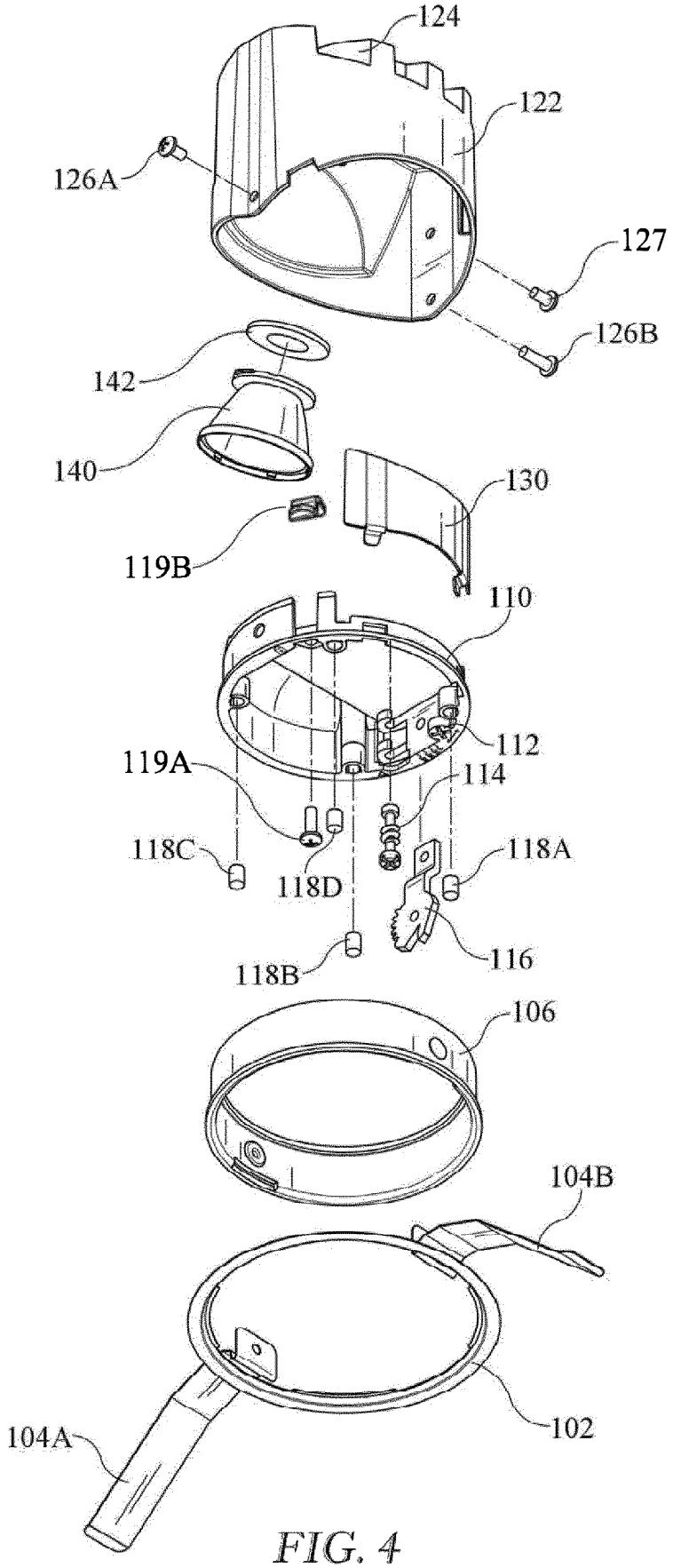
FIG. 4 illustrates an exploded view of components of a recessed lighting apparatus configured with selected aspects of the present disclosure, in accordance with various embodiments.

FIG. 4 is an exploded view of the apparatus 100. From the bottom up, the base 101 may be comprised of various components that are collectively referred to herein as the "base 101". For example, the base 101 may include a bottom ring 102, the one or more flanges 104A-B, and a top ring 106. In some embodiments, the top ring 106 may be slightly smaller diameter than bottom ring 102, e.g., so that the top ring 106 can be fixedly connected to the bottom ring 102. Further, the top ring 106 may include one or more apertures such that the one or more flanges 104A-B can be fixedly connected to the bottom ring 102 and the top ring 106 via one or more fastening elements (not depicted in FIG. 4), such as a screw, bolt, nut, pin, etc.

In some embodiments, the rotation ring 110 may be slightly smaller diameter than top ring 106, e.g., so that the rotation ring 110 is rotatable within the top ring 106 of the base 101, e.g., by way of a clearance fit, one or more bushings, one or more bearings, etc. In some other embodiments, these dimensions may be reversed, e.g., so that the top ring 106 has a smaller diameter than the rotation ring 110. In some embodiments, the rotation ring 110 may include one or more fastening elements 118A-D. The one or more fastening elements 118A-D may be a magnet, bolt, screw, pin, rivet, etc., such that a finishing trim (not depicted) may be affixed thereto within the apparatus 100. In some other embodiments, the rotation ring 110 may also include a securing mechanism. The securing mechanism may include a fastening element 119A, such as a bolt, screw, pin, rivet, etc., that can be secured to a bracket 119B. In some of those other embodiments, when the fastening element 119A is secured to the bracket 119B, the rotation ring 110 may be prevented from rotating, until the fastening element 119A is disengaged from the bracket 119B.

Further, one or more components for pivotally mounting the heat sink 120 to the rotation ring 110 are depicted. In some embodiments, the one or more hinges 126A-B may inserted through one or more apertures on the surface 122 of the heat sink 120 and also through one or more apertures of the rotation ring 110. The one or more hinges 126A-B allow the heat sink 120 to tilt when a torque is applied to the second drive 114 as described herein (e.g., as described in FIGS. 5-7). Moreover, in some embodiments, a fastening element 127 may be inserted through one or more of the apertures on the surface 122 of the heat sink 120 and also through the spur gear 116. The fastener can provide additional support for mounting the heat sink 120 to the rotation ring 110 and may include a bolt, screw, pin, rivet, etc. In some other embodiments, the fastening element may be omitted.

The apparatus may further include a shield 130 fixedly contained by the rotation ring 110. In some embodiments, if the apparatus 100 does not include an enclosure, the shield 130 can provide a barrier between a ceiling plenum and an interior of the apparatus 100. Accordingly, air flow from the ceiling plenum to a room in which the apparatus 100 is installed is prevented.

The light source 140 may be comprised of various components that are collectively referred to herein as the "light source 140". The light source 140 may be comprised of at least an optical cup 141 and an LED holder 142 configured to fixedly retain one or more LEDs. Although the depicted embodiment of FIG. 4 include the LED holder 142, that is not meant to limiting, and any other suitable light source disclosed herein may be utilized. The optical cup 141 may be luminously coupled to the LED holder 142 that fixedly retain one or more LEDs. The optical cup 141 and LED holder 142 may be mounted to the heat sink 120 and used to direct light generated by the one or more LEDs of the LED holder 142 in a given direction. In some embodiments, the optical cup 141 may be at least partially filled with material such as plastic or glass that is shaped to form one or more lenses. Additionally or alternatively, in some embodiments, an interior of the optical cup 141 may be empty, and instead its interior may be reflective, e.g., to direct light as described previously. Further, the optical cup 141 may have a cup shape, as shown in FIGS. 4-7, or may have other shapes, such as a cone shape, a pyramid shape, a box shape, etc.

FIGS. 5-7 are cross-sectional views of the apparatus 100 and illustrate a torque being applied to the second drive 114 by the mated tool 150 (e.g., as shown in FIGS. 5 and 6). Generally, as shown in FIGS. 5-7, the apparatus 100 directs light in a first direction FD that is parallel to a normal of a surface on which the apparatus 100 is mounted. However, the light source 140 (comprised of at least the optical cup 141 and the LED holder 142) is mounted on a lateral surface 128 within an interior of the heat sink 120. Consequently, the optical cup 141 of the light source directs light emitted by the one or more LEDs of the LED holder 142 in a second direction SD from a second end 141B of the optical cup 141 towards a first end 141A of the optical cup 141. Notably, the second direction SD can be at an oblique angle $\alpha$ (e.g., between approximately 0° and 45°) in relation to the first direction FD. In some embodiments, such as those described in FIG. 2, the foot 116B of the spur gear 116 may provide an indication of the oblique angle $\alpha$ (e.g., approximately 22.5° in FIG. 5, 45° in FIGS. 6, and 0° in FIG. 7).

In FIG. 5, the heat sink 120 is in a substantially vertical configuration. When a torque is applied to the second drive 114 by the mated tool 150, the torque may be transferred to the worm gear 114A that is mechanically coupled to the second drive 114. This transferred torque causes the worm gear 114A to interface with the teeth 116A of the spur gear 116, thereby causing the heat sink 120 and the light source 140 to both pivot. The heat sink 120 and the light source 140 may pivot in either a first direction 120-FD or a second direction 120-SD relative to the base 101 depending on which direction a force is applied (e.g., clockwise or counter-clockwise).

In some embodiments, and as depicted in FIG. 5, a force applied to the mated tool 150 creates a torque that may cause the mated tool 150 to rotate clockwise 150-CW (as viewed from below the apparatus 100). The force applied by the mated tool 150 creates a torque that is transferred to the second drive 114. The worm gear 114A, that is mechanically coupled to the second drive 114, may interface with the teeth 116A of the spur gear 116 and cause the heat sink 120 to tilt via one or more hinges 126A-B (see FIGS. 2-4) in a second direction 120-SD relative to the base 101 (e.g., as depicted in FIG. 7). In some other embodiments, and although not depicted, a force applied to the mated tool 150 may cause the mated tool 150 to rotate counter-clockwise (as viewed from below the apparatus 100). The force applied by the mated tool 150 creates a torque that is transferred to the second drive 114. The worm gear 114A, that is mechanically coupled to the second drive 114, may interface with the teeth 116A of the spur gear 116 and cause the heat sink 120 to tilt via one or more hinges 126A-B (see FIGS. 2-4) in a first direction 120-FD relative to the base 101 (e.g., as depicted in FIG. 6).

Accordingly, by using the mated tool 150 to apply torque to the second drive 114, the torque can be transferred to a gear assembly 114A, 116A to tilt the heat sink 120 and, consequently, pan the light source 140. The heat sink 120 can be pivoted approximately 22.5° in either the first direction 120-FD or the second direction 120-SD. However, the base 101 and the rotation ring 110 do not tilt with the heat sink 120 and/or the light source 140 when the torque is applied to the second drive 114 by the mated tool 150. Although the gear assembly 114A, 116A is depicted as a worm gear 114A and teeth 116A of a spur gear 116, that is not meant to be limiting. One of skill in the art will recognize that any other suitable gear assembly, e.g., helical gears, rack and pinion gears, bevel gears, miter gears, screw gears, internal gears, etc., may be utilized.

In FIG. 6, the heat sink 120 is tilted to a first pivoted configuration. The first pivoted configuration may be a result of a counter-clockwise torque applied to the second drive 114 by the mated tool 150 (not depicted). In the first pivoted configuration, the oblique angle $\alpha$ between the first direction FD and the second direction SD may change from approximately 22.5° (e.g., as shown in FIG. 5) to approximately 45°

(e.g., as shown in FIG. 6). The change in the oblique angle α may depend on the amount of torque applied to the second drive 114 by the mated tool 150. For example, a desired amount of torque can be applied, in the counter-clockwise direction, to the second drive 114 by the mated tool 150 to reach a desired oblique angle α as indicated by the marking on the rotation ring (e.g., as shown in FIG. 2). In should be noted that, in comparing the first pivoted configuration of FIG. 6 to the substantially vertical configuration of FIG. 5, the foot 116B of the spur gear 116 indicates the change in the oblique angle α from approximately 22.5° to approximately 45° (see angle markings in FIG. 2). Thus, light emitted from the light source 140 would appear to be aimed at a 45° angle relative to the base 101.

In FIG. 7, the heat sink 120 is tilted to a second pivoted configuration. The second pivoted configuration may be a result of clockwise torque 150-CW applied to the second drive 114 by the mated tool 150 (as shown in FIG. 5). In the second pivoted configuration, the oblique angle α between the first direction FD and the second direction SD may change from approximately 22.5° (e.g., as shown in FIG. 5) to approximately 0° (e.g., as shown in FIG. 7), such that the first direction FD and the second direction SD are substantially parallel. The change in the oblique angle α may depend on the amount of torque applied, in the clockwise direction, to the second drive 114 by the mated tool 150. In should be noted that, in comparing the second pivoted configuration of FIG. 7 to the substantially vertical configuration of FIG. 5, the foot 116B of the spur gear 116 indicates the change in the oblique angle α from approximately 22.5° to approximately 0° (see angle markings in FIG. 2). Thus, light emitted from the light source 140 would appear to be aimed directly downward from the apparatus 100.

Although the oblique angle α of FIGS. 5-7 is discussed as being 22.5° in the substantially vertical configuration, 45° in the first pivoted configuration, and 0° in the second pivoted configuration, that is not meant to be limiting. It should be understood that any desired oblique angle α between 0° and 45° can be achieved by applying torque to the second drive 114 in different directions (e.g., clockwise or counter-clockwise). Moreover, as a result of the heat sink 120 and the light source 140 rotating along with the rotation ring 110, the light source 140 can be panned at any angle between 0° and 45°, and rotated about the light passage 360°, such that the light source 140 can be aimed at any desired object or in any desired direction.

Accordingly, an adjustable recessed lighting apparatus consistent with embodiments disclosed herein enables a light source to be rotated at least 360° (in either a clockwise or counter-clockwise direction) and panned between 0° and 45° (relative to a surface on which the apparatus is mounted). This allows a user to direct light emitted by the apparatus at a particular object or particular area more efficiently. Further, by using a mated tool to rotate and/or pan the light source, a user need not adjust the light source by hand, thereby avoiding any potential risk of being injured due to high temperatures of the apparatus. Even further, by using the mated tool to rotate and/or pan the light source, the user need not be concerned with transferring oil from a hand of the user to an optical element of the light source, thereby preserving the ability of the optical element to direct the light emitted by the light source.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc. It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. An adjustable recessed lighting apparatus comprising:

a base that is mountable to a surface and includes a light passage that generally directs light in a first direction (FD) parallel to a normal of the surface;

a rotation ring that is rotatably mounted to the base such that the rotation ring is rotatable about the light passage;

at least one light source mounted within the apparatus to emit the light through the light passage in a second direction (SD) that is oblique ($\alpha$) to the first direction (FD);

a first drive that is fixedly secured to the rotation ring, wherein the first drive does not independently rotate with respect to the rotation ring, and wherein the first drive transfers torque applied to the first drive to the rotation ring causing rotation of the rotation ring relative to the base about the light passage; and a second drive that is fixedly secured to the rotation ring, wherein the second drive transfers torque applied to second drive to a heat sink assembly causing pivoting of the heat sink assembly and the at least one light source relative to the base about one or more hinges.

2. The adjustable recessed lighting apparatus of claim 1, wherein the rotation ring is rotatable about the light passage 360° in a clockwise direction or a counter-clockwise direction.

3. The adjustable recessed lighting apparatus of claim 1, further comprising:

the heat sink assembly, wherein the heat sink assembly is thermally coupled to the at least one light source and is pivotally mounted to the rotation ring via one or more of the hinges such that the at least one light source and the heat sink assembly are pivotable about one or more of the hinges.

4. The adjustable recessed lighting apparatus of claim 3, wherein the heat sink assembly and the at least one light source are pivotable about the one or more hinges approximately 22.5° relative to the first direction (FD) that is parallel to the normal of the surface.

5. The adjustable recessed lighting apparatus of claim 3, wherein the heat sink assembly and the at least one light source rotate along with the rotation ring when the torque is applied to the first drive.

6. The adjustable recessed lighting apparatus of claim 5, wherein the rotation ring, the heat sink assembly, and the at least one light source rotate independent of the base.

7. The adjustable recessed lighting apparatus of claim 1, wherein the heat sink assembly and the at least one light source pivot independent of the base and the rotation ring.

8. The adjustable recessed lighting apparatus of claim 1, wherein at least one of the first drive and the second drive are shaped to receive a first type of tool.

9. The adjustable recessed lighting apparatus of claim 8, wherein at least one of the first drive and the second drive are shaped to receive a second type of tool, wherein the second type of tool is different from the first type of tool.

10. The adjustable recessed lighting apparatus of claim 1, wherein the rotation ring further includes a securing mechanism that, when engaged, prevents the rotation ring from rotating.

11. The adjustable recessed lighting apparatus of claim 1, wherein the heat sink assembly and the at least one light source rotate along with the rotation ring when the torque is applied to the first drive; and wherein the heat sink assembly and the at least one light source pivot independent of the base and the rotation ring.

12. The adjustable recessed lighting apparatus of claim 11, wherein the rotation ring, the heat sink assembly, and the at least one light source rotate independent of the base.

13. The adjustable recessed lighting apparatus of claim 11, wherein the rotation ring is rotatable about the light passage 360° in a clockwise direction or a counter-clockwise direction.

14. The adjustable recessed lighting apparatus of claim 11, wherein the heat sink assembly and the at least one light source are pivotable about the one or more hinges approximately 22.5° relative to the first direction (FD) that is parallel to the normal of the surface.

15. The adjustable recessed lighting apparatus of claim 11, wherein at least one of the first drive and the second drive are shaped to receive a first type of tool.

16. The adjustable recessed lighting apparatus of claim 15, wherein at least one of the first drive and the second drive are shaped to receive a second type of tool, wherein the second type of tool is different from the first type of tool.

* * * * *